United States Patent [19]

Stephens, Jr.

[11] Patent Number: 4,951,361

[45] Date of Patent: Aug. 28, 1990

[54] RELEASABLE LOOP RETAINER

[76] Inventor: Albert L. Stephens, Jr., 232 S. June St., Los Angeles, Calif. 90004

[21] Appl. No.: 374,284

[22] Filed: Jun. 30, 1989

Related U.S. Application Data

[63] Continuation-in-part of Ser. No. 167,530, Mar. 14, 1988, Pat. No. 4,847,955.

[51] Int. Cl.[5] ..... A45F 5/02

[52] U.S. Cl. ..... 24/3 K; 24/546

[58] Field of Search ..... 24/3 K, 3 R, 3 D, 20 S, 24/26, 27, 546, 67.9, 30.5 S; 70/456 R

[56] References Cited

U.S. PATENT DOCUMENTS

| | | | |
|---|---|---|---|
| 1,121,800 | 12/1914 | Childress | 24/26 |
| 1,198,105 | 9/1916 | Butler | 24/3 K |
| 1,341,930 | 6/1920 | Roblin | 24/3 K |
| 1,922,594 | 8/1933 | Lippstadt | 24/3 K |
| 2,472,172 | 6/1949 | Ovens et al. | 24/27 |
| 2,828,900 | 4/1958 | LeRoy | 24/3 D |
| 3,377,666 | 4/1968 | Sherman | 24/26 |
| 3,882,573 | 5/1975 | Thomas, Jr. | 24/30.5 T |
| 4,658,822 | 4/1987 | Kees, Jr. | 24/546 |
| 4,847,957 | 7/1989 | Ranta | 24/546 |

*Primary Examiner*—Victor N. Sakran

*Attorney, Agent, or Firm*—William K. Rieber

[57] ABSTRACT

A holder for keys or other orificed elements comprising a helical loop of a thin rigid but resilient element having overlapping end portions, said end portions being flattened to present faces abutting each other with at least one curved segment not in the plane of the loop nesting with the curved segment of the other end portion. When the sides of the loop adjacent the end portions are pressed inwardly towards each other, the curved segments are caused to unnest by camming action, thereby separating the tips of each end portion from contact with the other end portion so that a key or other orificed element may be threaded between the end portions and onto or off of the loop. Upon release of the pressure on the sides of the loop, the end portions return to their nesting position and any key or other orificed element may then be moved freely around the loop.

3 Claims, 6 Drawing Sheets

RELEASABLE LOOP RETAINER

This application is a continuation-in-part of application Ser. No. 07/176,530 filed Mar. 14, 1988 now U.S. Pat. No. 4,847,955 issued Jul., 18, 1989.

The present invention relates generally to releasable loop retainers, which may be employed as key holders or key rings, as well as paper clip holders and dispensers.

BACKGROUND OF THE INVENTION

Key holders and key rings have been used almost as long as keys themselves, and like keys, the devices used to hold a set of keys together have become more complex and intricate.

Traditionally keys have been collected on a standard key ring consisting of a helical coil of several (usually two) turns of spring wire having chisel-shaped ends designed to be pried up with a knife blade or a strong fingernail to permit the insertion of a key over the thus exposed end of the coil and sliding of the key around the coil until the eye of the key surrounds all of the turns of the helix. Such standard key rings have usually been cold-formed to press the three coils into a smooth layered torus and polished to prevent snagging cf the ring when carried in a pocket, and to facilitate sliding a key around the helical coil when adding or removing a key from the ring.

Some of the key holders presently in use are heavy, bulky, mechanically complex or have sharp edges which can damage clothing. Still others are difficult to use and can cause broken fingernails on attempting to add or subtract keys. These are all undesirable features.

In addition to any one or more of the noted undesirable features, known devices do not fully satisfy the current demand for convenience. For example, with the increase in popularity of automatic car washes, valet parking, and the like, the ability to easily remove a key or keys from the key holder has made convenience an important element in the usefulness of a key holder. A key holder with keys attached which can be easily removed from or added to the ignition lock key of a running automobile engine is also a great convenience not found in key holders presently in use. Also, to be able to quickly and easily remove any number of keys from a key holder in any order of priority for whatever reason is desirable. A solution to avoiding undesirable features of key holders presently in use and providing the convenience which contemporary society demands is the subject of this invention. The present invention, however, may also be adapted to retain and release other objects, such as paper clips, which are configured in a closed loop or may be orificed in a manner permitting a thin elongated element to be passed therethrough.

SUMMARY OF THE INVENTION

According to the present invention, there is provided a releasable loop retainer, which, in a form to serve as a key holder, is constructed of a thin rigid, but resilient, material which can pass through the eye of a key and is formed into a loop, having two separate lapped end portions or "fingers" overlapping each other in a helical orientation, viz. in a side-by-side relationship so that the lap juncture or interface may lie generally in the plane of the loop. These "fingers" press against each other in several different configurations.

The cross-sectional dimensions of the lapped fingers are such that when the lap juncture is in "closed" or static condition, any key or all keys on the ring may be passed entirely around the ring traversing the closed lap juncture in either direction. Preferably the lap interface is flat so that the lapped fingers may freely slide against each other during opening or closing as will be described.

The shape of the loop should be such that, by squeezing the body of the loop on both sides of the overlapping ends (i.e., applying a force in the plane of the loop), the loop is deformed so that the two end portions slide relative to each other and, because of their configuration a displacement occurs which produces sufficient separation between them to enable the key or other orificed element to be passed onto or out of the loop. Once the eye of the key passes under the distal tip of one of the fingers so as to separate the fingers at this point, squeezing pressure may be released and the key slid along the lap juncture, separating the fingers as it moves until the key is fully inserted or fully removed. Motion of the key from the proximal to the distal end of a finger removes the key, while sliding motion from the distal end to the proximal end of the finger inserts the key onto the loop.

For purposes of the invention, the loop may be circular or formed in various non-circular shapes, and the lap interface may be co-planar with, or curved out of the plane of the loop as will be described below. Preferred operation is achieved if the length of the lapped fingers is approximately one-fourth of the circumference of the loop. The loop may be made of one piece of material of uniform composition and flexibility, or of flexible portions and non-flexible portions made of similar of different materials. A key, or other orificed element, enters the loop by threading it onto a displaced end and sliding it in the same direction until it passes between the spaced apart overlapping end portions of the loop. Removal from the loop may be accomplished by sliding the key or element between the spaced apart ends and off. Either adding or removing a key or other element from the loop can be accomplished in one quick motion.

After insertion or removal of a key or other element, pressure on the loop is released allowing it to return to its original configuration with its overlapping ends nested against each other. This permits all keys, or other elements, placed on the loop to move freely around the closed loop. Any key, or other element, on the loop may be removed at any time. Also, a chain for attachment to the person or clothing may be interconnected to the holder as easily as the individual keys or other orificed elements.

The loop material should be inherently spring-biased to return to its original configuration as a closed loop when the body of the loop is no longer squeezed. This assures that the loop will not accidentally open to permit the loss of a key or other orificed element. Preferred operation is also achieved with ring materials having the characteristics of spring steel, that is, materials which are capable of relatively extreme bending or twisting without exceeding the elastic limit and taking a permanent set. The two end portions of the loop overlapping engage each other in one of several possible configurations and are formed along the contacting surfaces permitting relative sliding movement with little friction when the body of the loop is squeezed to add or subtract a key, or other orificed elements. The combined thickness of the respective end portions should be such as to easily pass through the eyes of keys or other orifices of the elements when the body of the loop is not being squeezed.

It is a significant feature of the present invention that the holder is manufactured so that when completely formed, and in static condition ready for use, the material of the loop contains internal trapped flexure stresses which urge the lap interfaces into intimate, yielding pressure contact with each other and also urge the distal tips of the lapped fingers tightly against the opposing proximal lapped portions to obviate snagging.

In operation, the loop is squeezed between thumb and forefinger causing the overlapping ends to move relative to each other to produce spacing between them. A key or orificed element can be threaded onto either of the protruding ends to enter the loop by sliding it past the overlapping end portions onto the loop. In removing a key or other element, the loop is squeezed as before and the key or element is removed by sliding it along the loop between the spaced apart ends and off the outermost end. Due to the springlike consistency of the key loop material, it automatically returns to its original configuration once squeezing is stopped. Attached keys or other elements are unable to "fall off" the loop because the overlapping ends are no longer spaced apart and the device once again resembles a closed loop.

It bears emphasis that the holder of the present invention is so constructed that when "closed", i.e. in the absence of external pressure, the entire assortment of keys or other articles on the loop may be circulated around the loop, passing the lapped juncture in either direction, for the purpose of selecting a desired article to be removed or selecting the desired point in the assortment at which to insert an added article.

According to the present invention, two alternate modes of construction and operation are provided to effect opening in the loop in response to diametric squeezing thereof. In one mode of operation the loop is formed generally in the shape of the capital "D" turned on its side with the curved part downward, and with the lap-juncture located at the straight part of the "D". In this form, the squeezing of the loop causes the distal tips of the lapped portions to project beyond the corners of the "D" so that a key may be attached by hooking the eye over the projected tip.

In another mode of operation, the lap interface is curved out of the plane of the loop into a generally "S" shape which functions as a cam to separate each distal tip from the juncture interface when the loop is squeezed. In this form, the distal tip is lifted from the juncture interface, whereas in the "D" form the distal tip slides lengthwise off the juncture interface.

In the preferred embodiment of the present invention, the two end portions are bent along the plane of abutting surfaces to form a generally sinuous or S-like nested interface when no pressure is applied to the side of the loop. However, when the sides of the loop are squeezed, the end portions move out of their nesting and result in the ends becoming spaced from each other thereby providing an opening to receive a key or other element and reducing the distance which the key or other element itself must slide along the abutting surfaces to enter or leave the loop. The "S" like interface facilitates return of the two ends to a fixed position, further preventing keys from falling off the ring, while still permitting the rotation of keys on the ring to position any one for removal.

It is also a feature of the present invention to provide a configuration for the overlapping end portions which configuration prevents the ends from passing each other beyond the point which could adversely affect the resiliency of the loop. Thus, where the overlapping ends are curved in such a manner as to nest in unpressurized condition of the loop and at least one end portion cams upwardly and out of the mating curved section of the other end portion upon the application of finger pressure inwardly to both sides of the loop, a shoulder may be provided on one end portion and a recess in the other, so that, when the camming occurs, it is limited to where the shoulder becomes caught in the recess. This acts to prevent the loop from being "oversqueezed" to a point where it may no longer be able resiliently to return to its original shape.

Alternatively, the same result can be accomplished by providing a second valley beyond the peak over which the camming occurs so that the downwardly curved section of the end portion which is so cammed upwardly, drops down into such valley or recess. In such a disposition, additional finger pressure would be required to force the nesting section to cam out of the second valley. However, since the tip of the one end portion would be spaced from the other end portion at that point so that the key or other element may be slipped over it, there would be no reason for the user to squeeze the loop further.

Special material alloys are known to have the characteristic of unfailingly returning to an original shape and these can be usefully employed in construction of this invention. See the January 1988 issue of *Popular Science*, page 78, "*Metals That Remember*" by Steven Ashley. In addition, however, the retainer of the present invention could be made of any rigid resilient plastic material such as high density polyethylene.

DESCRIPTION OF THE DRAWINGS

FIGS. 15(*b*) and 16*b*) are front views of the holder shown in FIG. 14 but with the loop plane vertical and the lap-joint located at the top preparatory to opening the loop to receive a key. As can be seen best in FIGS. 15(*b*) and 16(*b*), the general shape of the loop is similar to a letter "D" turned on its side with the straight part at the top. The lapped fingers lie within the straight part of the "D", with the distal ends terminating well back of the corner of the "D" even when the holder is squeezed to open the lap joint.

DESCRIPTION OF PREFERRED EMBODIMENTS

In accordance with the present invention, there is provided an improved key or other orificed element holder or ring for retaining one or more keys, or other such elements, which is especially advantageous in allowing for them ready and convenient attachment and disengagement.

FIRST VERSION

Figure 1:
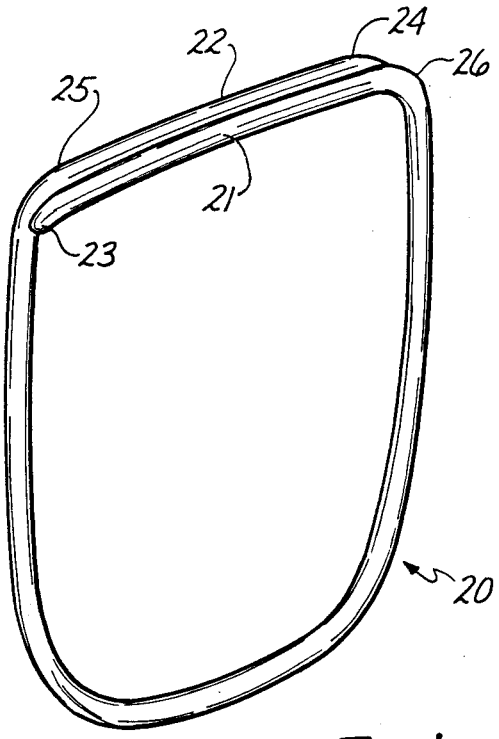
FIG. 1 is a perspective view of a first version of the invention in the "closed" position.
Figure 2:
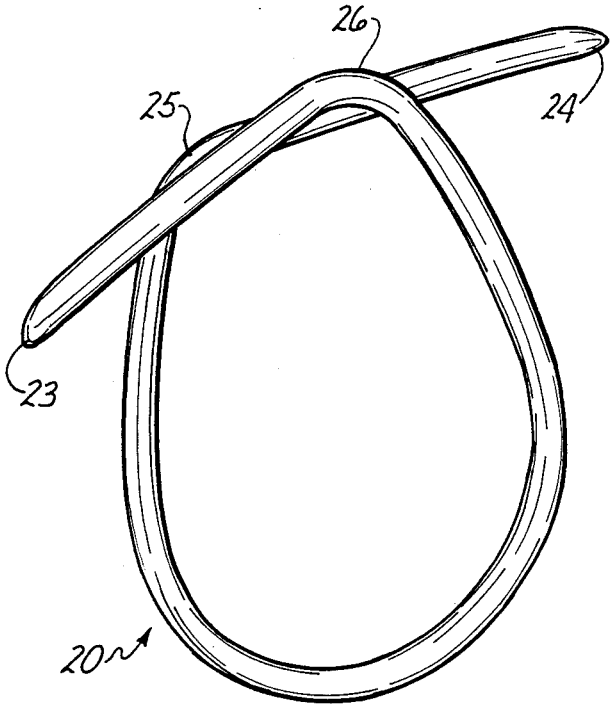
FIG. 2 is a side elevational view of the invention depicted in "open" position for receipt or discharge of a key.
Figure 3:
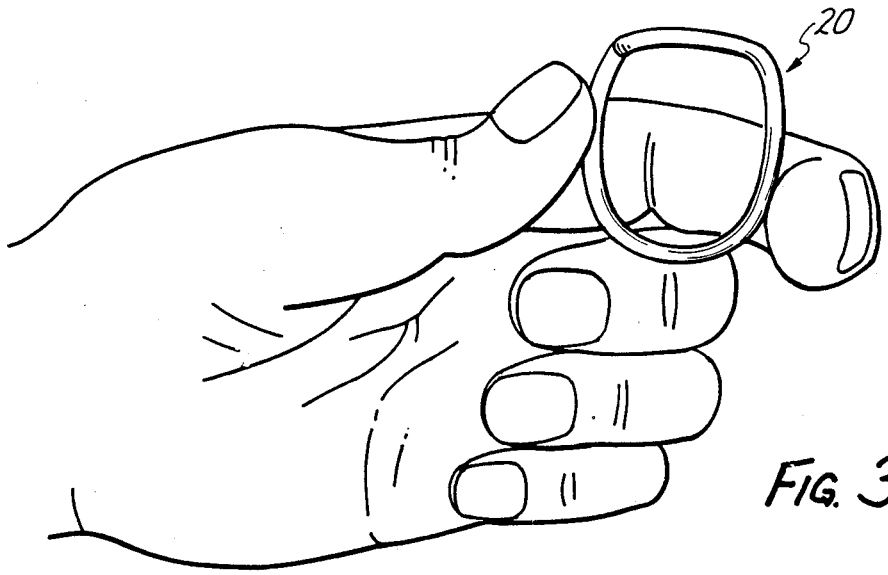
FIG. 3 is a perspective view of FIG. 1 in the hand of a person using the invention.

A first version of this invention is depicted in FIGS. 1, 2 and 3 where the keyholder is seen to comprise a loop of spring-like material formed into a closed path or ring lying in substantially a single plane with end portions 21 and 22 overlapping each other. The holder may be constructed from a length of round wire such as steel, beryllium copper, graphite, boron or other metallic alloys, or of a suitable plastic or other compound which can be formed into desired shape and has a rigid but resilient or springlike characteristic, such as high density polyethylene. The tips 23 and 24 of the overlapping end portions, 21 and 22 respectively should reach to the outside of the curved parts 25 and 26 joining the overlapping portions to the remainder of the keyholder. FIG. 3 shows the key holder being held between thumb and finger prior to opening. On squeezing the keyholder between thumb and finger the loop is deformed as shown in FIG. 2 thereby opening the loop to receive or discharge a key.

The overlapping end portions 21 and 22 must press tightly against each other to retain the key loop. It is necessary to prevent the ends 23 and 24 and end portions 21 and 22 from rotating about each other so as to contact each other along their "back" sides, or lose contact altogether resulting in opening of the keyholder loop to permit keys to fall off or out of the loop. This can be accomplished in a number of ways, for example, by making the overlapping ends with flat sides pressing tightly against each other. It can also be accomplished by simply making the ends extend to the outermost part of the loop rounded corners 25 and 26 when it is at rest and not being squeezed.

Another way is to flatten the overlapping ends to broaden and thus enlarge the plane of abutment. Instead of one-piece construction, the overlapping ends can be separately made in satisfactory configuration and attached to the loop material in any conventional manner.

SECOND VERSION

Figure 4:
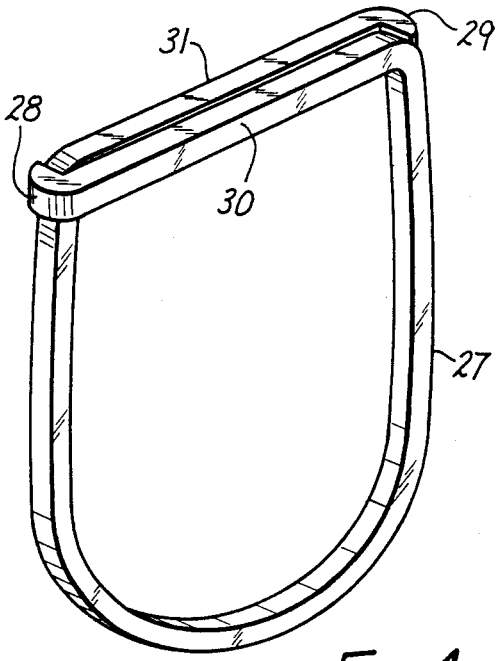
FIG. 4 is a perspective view of a second version in closed position.
Figure 5:
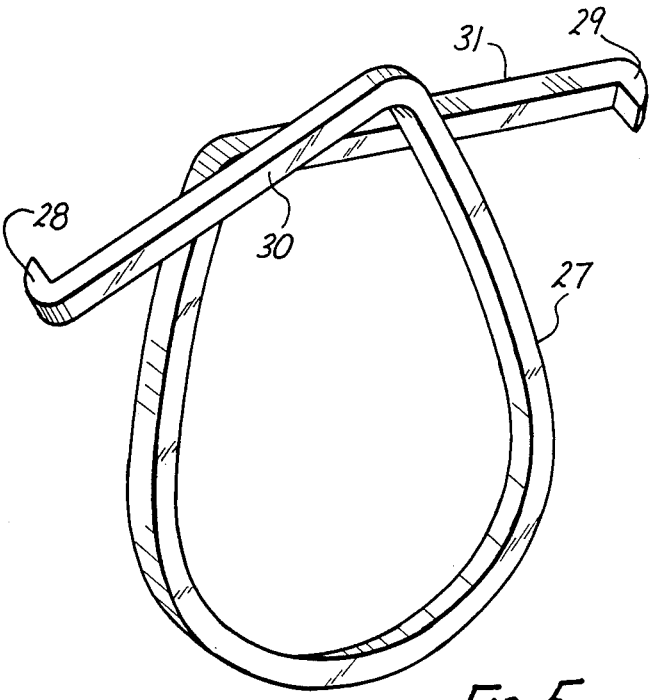
FIG. 5 shows FIG. 4 in "open position".
Figure 6:
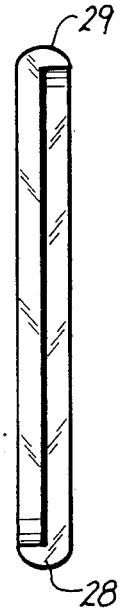
FIG. 6 is top plan view of FIG. 4.

FIGS. 4, 5 and 6 show another embodiment of the invention which differs from that of FIGS. 1–3 primarily in that the tips 28 and 29 of the overlapping end portions 30 and 31, are formed into short hooks which extend at an angle transversely of the key holder plane and incidentally the body of the key holder loop 27 is ribbon shaped in cross section. It could as well have a different cross sectional shape. The hook ends assure that after squeezing the sides to open the loop as shown in FIG. 5, the loop will return to its original configuration as in FIG. 4 upon cessation of squeezing. In addition, the hooks will prevent the contacting end portions from inadvertently rotating about each other so as to have their "back sides" toward each other.

THIRD VERSION

Figure 7:
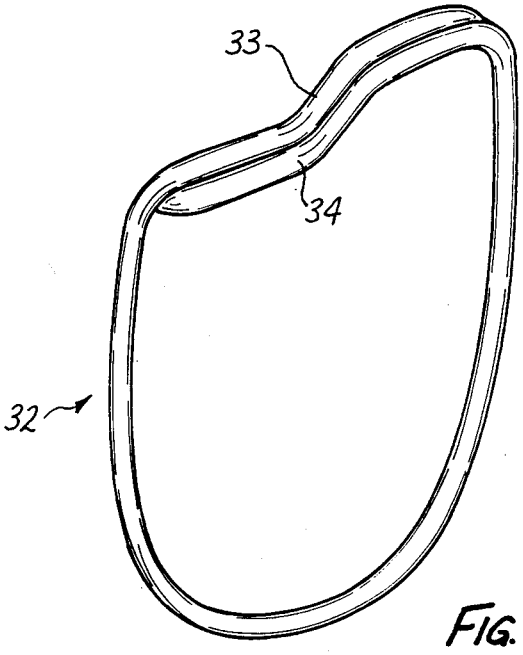
FIG. 7 is a perspective view of a third embodiment of the invention shown "closed".
Figure 8:
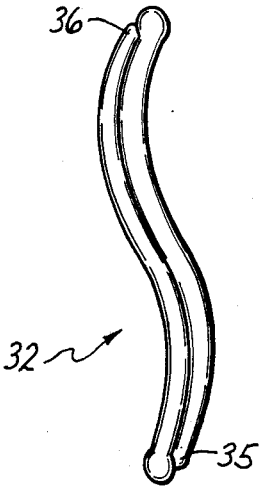
FIG. 8 shows a top plan view of the FIG. 7 version.
Figure 9:
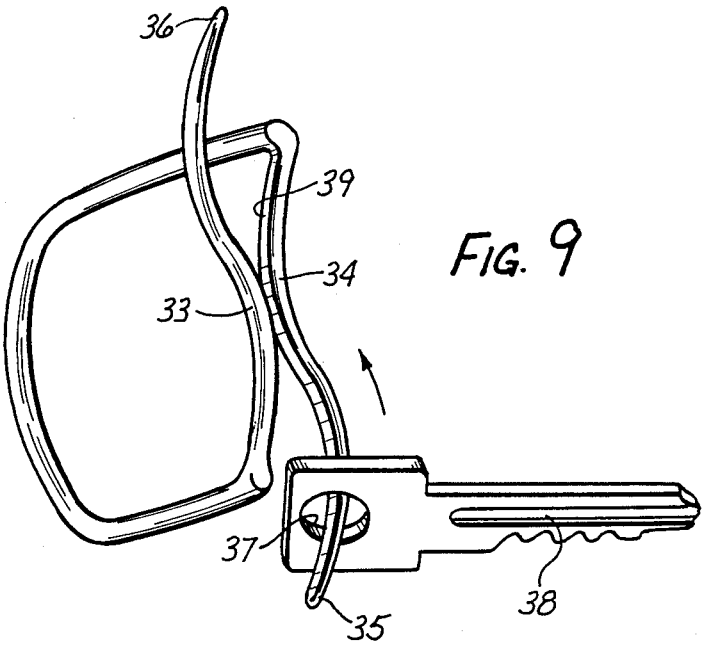
FIG. 9 shows a perspective view of the FIG. 7 embodiment shown "open".

Reference is now made to FIGS. 7, 8 and 9 for the ensuing description of another embodiment of the key holder. As in the first described embodiment (FIGS. 1–3), the key holder is constructed of a loop 32 of springlike material having overlapping end portions 33 and 34. In this version, however, the end portions are elongated planar members which when viewed in plan (FIG. 8) are formed into a sinuous or "S" shape. When closed, the end portions nest within each other with their respective tips 35 and 36 being tapered so as to form a smooth surface that will not scratch the hands or tear the clothing.

In use, the key holder loop body is gripped between the thumb and index finger as shown in FIG. 3 and squeezed. This forces the sides of the holder toward each other in the loop plane causing the end portions to be moved out of nesting relation which cams the tips 35 and 36 apart as well as moving them outwardly of the respective holder sides (FIG. 9). The eye 37 of a key 38 may be threaded on one of the tips and moved in the space which now exists between the end portions 33 and 34 Further movement of the key in the same direction shown by arrow 39 in FIG. 9 forces the still contacting holder end portions apart and locates the key on the holder loop. On cessation of squeezing, the inherent spring characteristics of the holder cause it to resume the position of FIG. 7.

Removal of a key 38 from the holder is accomplished in much the same way as described for attaching a key, only the direction of key movement is different. First, the holder is gripped tightly enough to cause the tips to extend outwardly of the holder body as in FIG. 9. The key then slides along the loop toward one of the ends until the key eye 37 separates the end portions allowing the key to move off a tip 35 or 36, as the case may be.

It is contemplated that the end portions 33 and 34 have flattened contacting surfaces such as 39. One way of achieving this is to take an appropriate length of spring wire, for example, of uniform cross-section and flatten the end portions to the proper desired dimensions and condition. Another way is to make the end portions of separate pieces with flattened surfaces which are welded or silver soldered, for example, to a spring wire to complete the loop which produces a configuration substantially like is shown in FIG. 9.

ADDITIONAL VERSIONS

Figure 10:
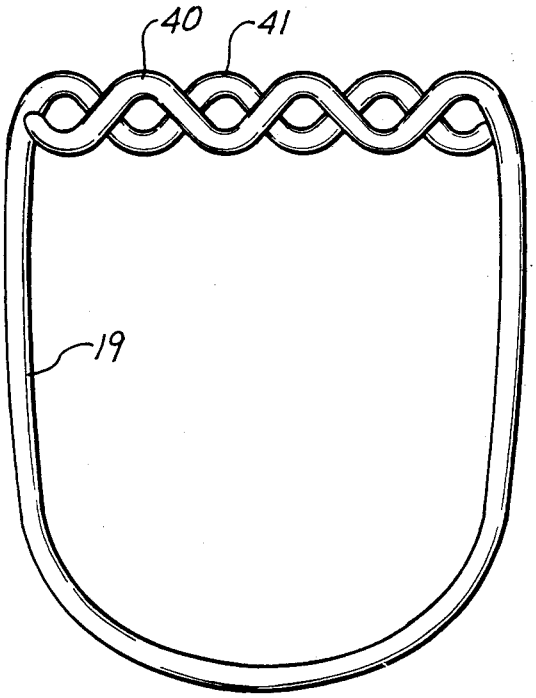
FIG. 10 is a perspective depiction of a fourth version of the invention.
Figure 11:
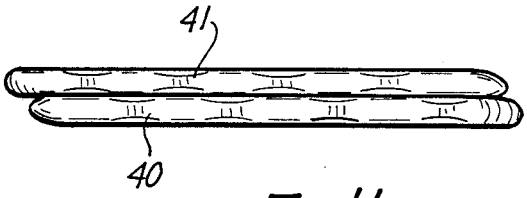
FIG. 11 is a top plan view of the key holder of FIG. 10.

FIG. 10 depicts a still further or fourth version of the invention differing primarily in that each overlapping end portion 40 and 41 includes a plurality of sinuous portions all lying in the plane of the holder main loop 42. As seen best in FIG. 11, the end portions are in smooth continuous contacting relation. Operation is the same as in the previously described embodiments.

Figure 12:
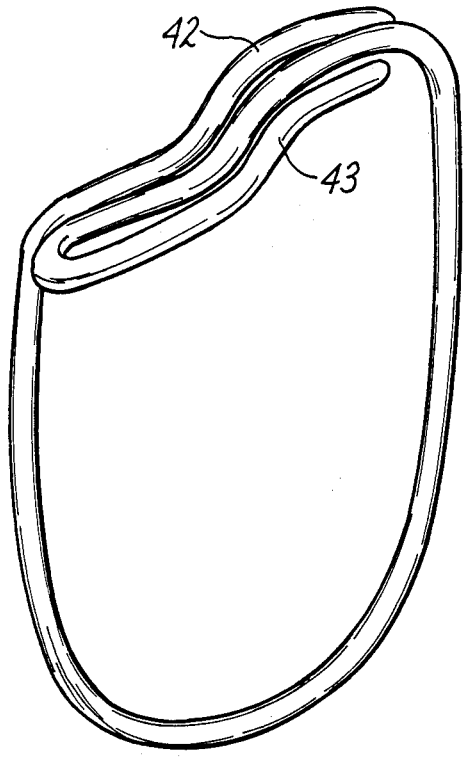
FIGS. 12 and 13 are perspective views of fifth and sixth embodiments respectively.

Another or fifth version is shown in FIG. 12 primarily differing in having modified overlapping end portions 42, 43. More particularly, each end portion is formed by bending a length of the holder loop material back onto itself, and then shaping to the sinuous or "S" shape face contacting condition of FIG. 7, 8 and 9. Each end portion, therefore, has a width equal to twice that of a holder side part which is advantageous in avoiding the manufacturing step for flattening the end portions such as in the FIG. 7 embodiment, for example.

Figure 13:
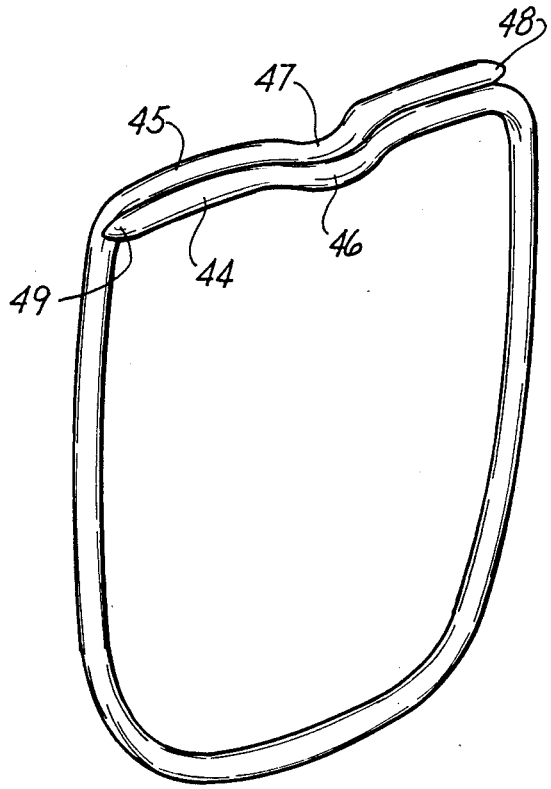

The sixth embodiment depicted in FIG. 13, has overlapping end portions 44 and 45 of the same dimensions as the remaining loop material. A bend 46 in end portion 44 nests with a similarly dimensioned complementary bend 47 in end portion 45 when the key holder is closed. Finger pressure on the holder sides causes the tips 48 and 49 to extend outwardly and to open for receiving a key. Preferably the abutting end portions should be flat along the plane of abutting surfaces.

Figure 14:
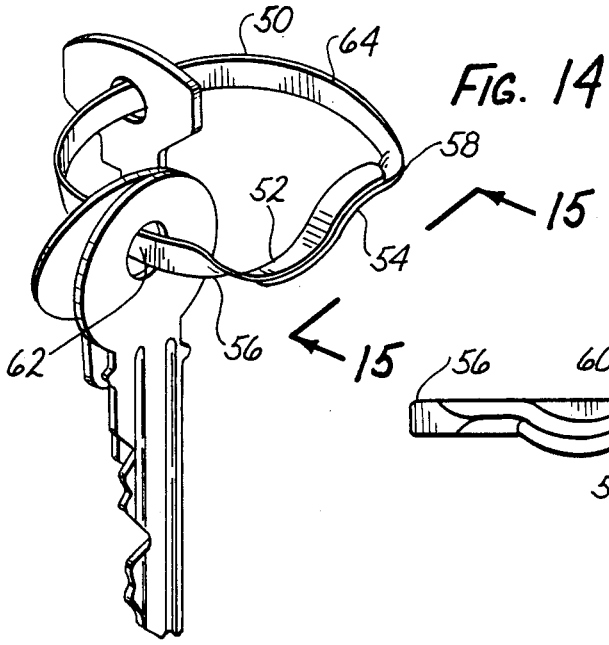
FIG. 14 a perspective view of a seventh embodiment showing keys mounted on the closed loop lying in a horizontal plane.
Figure 15:
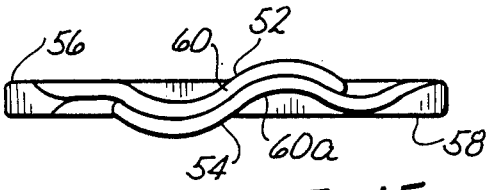
FIG. 15(*a*) is a view taken in the direction of the arrows 15—15 in FIG. 14 with the lapping end portions or fingers in closed or nested position.
Figure 16:
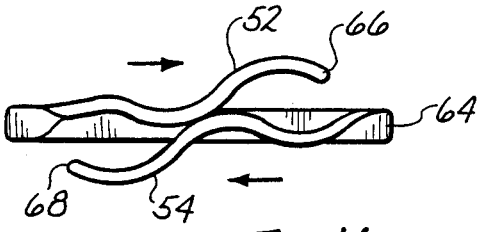
FIG. 16*a* is a view similar to FIG. 15(*a*), but showing the end portions pushed together to unnest them.

In the seventh embodiment of the invention illustrated in FIGS. 14–16(*b*), the loop 50 is generally circular with its overlapping end portions 52, 54 having been twisted at 56 and 58 respectively, ninety degrees, and formed with at least one sinusoidal curve 60,60*a* so that in the loop,s un-pressured condition the overlapping end portions 52 and 54 nest together. However, as illustrated in FIG. 16(*b*), upon the application of inward pressure to both sides 62, 64 of the loop, the curved end portions 52,54 will cam apart to permit a key or other orificed element to be slipped onto one of the tips 66, 68, and thence between the end portions 52,54 and onto the loop 50.

Figure 17:
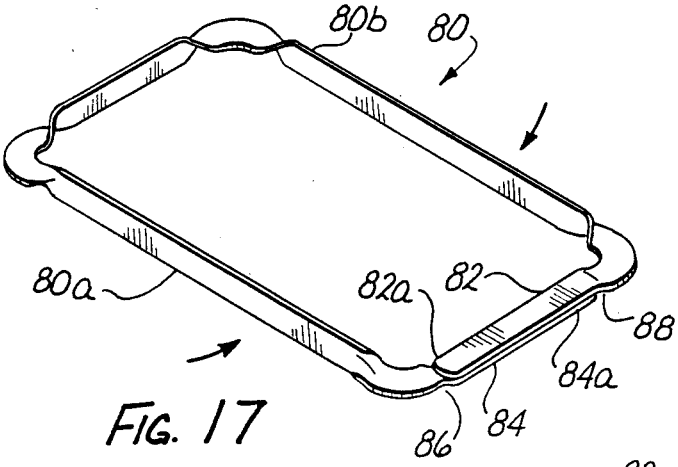
FIG. 17 is a perspective view of an eighth embodiment of the invention.
Figure 18:
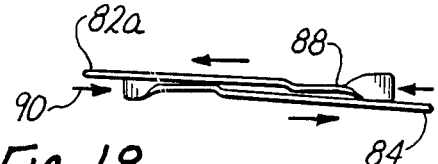
FIG. 18 is an end view taken in the direction of the arrows in FIG. 17.

The embodiment of FIG. 17 and 18, represents another approach to accomplishing the objective of the It should be noted that in the seventh version illustrated in FIG. 14, the holder is not operated to receive a key be projecting the distal ends outside the perimeter of the loop. Instead, the distal ends are separated at the interface by a camming action, the ends moving perpendicularly to the interface, so that a key or other orificed object, can be inserted over the distal end and slid inwardly to wedge the lapped end portions apart as the key is inserted.

This camming action can be best understood by observing FIGS. 15(*a*) and 15(*b*) which show the condition of the holder prior to squeezing, and FIGS. 16(*a*) and 16(*b*) which show the condition of the ends after squeezing.

When the squeezing pressure is released, the ring is allowed to expand by its inherent resilience and the end portions return to their fully nested and closed condition, at which point further expansion of the ring is arrested by contact of the inward curve of the tips 66 and 68, each of which, in nested position contacts a congruent lobe at the proximal end in the opposing end portion or finger. This action assures that when closed and in fully nested position the tops remain snugly seated against the opposing portions so as to avoid catching on threads and the like.

To facilitate flexure of the holder in response to the squeezing action as above described the seventh version is constructed of a band-like stock several times wider than its thickness as can be seen in FIG. 14. The lap joint is generally vertical when the holder is in position for use and the stock is twisted 90 degrees at the corners of the "D" so as to be resiliently flexible in response to squeezing pressure applied with the thumb and forefinger as shown in FIG. 3. present invention. As may be seen in these figures, the loop 80 is rectangular and the overlapping ends 82,84 are flat with their respective tips 82*a*,84*a* seated in slightly curved recesses 86,88 respectively in the end portions 84,82. Upon the application of pressure to the sides 80*a*, 80*b* of the loop 80, in the direction of the arrows 90,92, the tip's 82*a*,84*a* of the overlapping end portions 82,84, are cammed out of their respective recesses 86,88 to protrude past the sides 80*a*, 80*b*, thereby enabling a key or other orificed element to be slipped over the tips 82*a*, 84*a* and between the overlapping end portions 82,84 and onto the loop 80.

Figure 19:
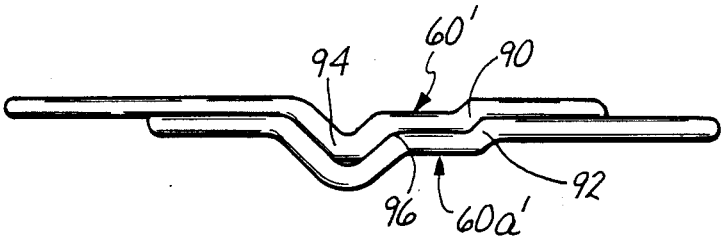
FIG. 19 illustrates one possible configuration of the overlapping end portions to restrain their being inadvertently oversqueezed, with the ends in nested position.
Figure 20:
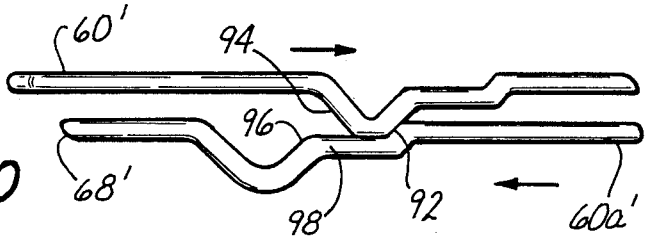
FIG. 20 is of the configuration shown in FIG. 19, but with the ends cammed apart to the restraining shoulder.

FIGS. 19 and 20 illustrate a possible modification of the nesting configuration of the embodiment of FIGS. 14–16 in which the configuration of the end portions 60, 60*a*, viz 60', 60*a*', has been modified to provide a face and shoulder 90, 92 respectively. These second curvatures also nest when the loop has not been subjected to inward finger pressure upon the sides, as shown in FIG. 19. However, when such pressure is so applied, after the curved portion 94 has come up over the hump 96, it slides across flat segment 98 until it strikes the shoulder 92 where it will require further pressure to force it to cam over that shoulder 92. However, since the tips 66' and 68' are already spaced apart from the other end portions 60', 60*a*', the key or other element may be slipped onto the retainer. Consequently, there is no reason for the user to apply further finger pressure to effect a second camming action. Thereby, the user is discouraged from further squeezing the sides of the loop to the point where its resiliency may be destroyed and hence its ability to return to its original state is lost.

Figure 21:
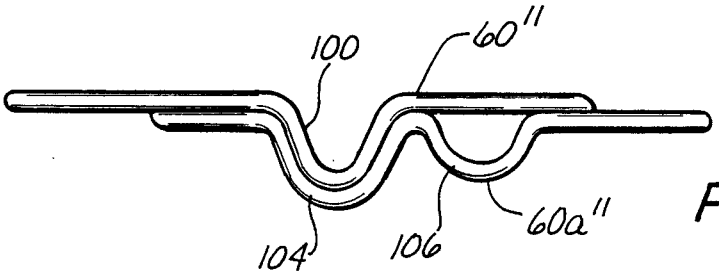
FIG. 21 is similar to FIG. 19, but illustrates a second possible configuration to inhibit oversqueezing of the end portions.
Figure 22:
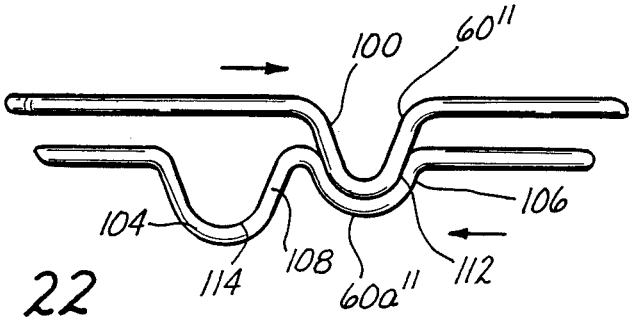
FIG. 22 shows the embodiment of FIG. 21 in open but restrained position.

FIGS. 21 and 22 illustrate a different possible configuration for the end portions 60, 60*a* shown in FIGS. 14–16. Thus, in FIGS. 21 and 22 the end portion 60" is formed with a single curved segment 100, while the end portion 60*a*" are shown, is not squeezed, the curved segment 106. When the loop (not shown) of which the end portions 60" and 60*a*" are shown, is not squeezed, the curved segment 100 nests in the curved segment 104 as shown in FIG. 21. It should be noted that the curved segment 106 is of lesser amplitude or depth than the segments 100, 104. When the sides of the loop are squeezed, the curved segment 100 of the end portion 60" will be caused to cam up over the side 108 and its peak 110, whereupon it will drop into the valley 112 of the second curved segment 106. This will result in inhibiting further relative parallel movement between the end portions 60" and 60*a*'. However, because the valley 112 is of lesser depth than the valley 114 of the curved segment 104, when the segment 100 seats in the valley 112, the tip 66" will be elevated from the end portion 60*a*', thereby enabling a key or other orificed element to be slipped onto the loop (not shown). There is, thus, no reason for the user to squeeze the loop further to where its resiliency would be adversely affected.

While the present invention has particular application as a key holder, it may also be employed to receive and retain other orificed or closed loop elements which may be slipped between the various types of overlapping ends of the loop herein illustrated and described. Among such orificed or closed loop elements for which the invention may be particularly useful are paper clips in either a single or multiple sizes, any selected one of which may be removed from the loop simply by moving the group of clips around the loop until the one to be removed is positioned next to the tip of one of the overlapping ends which will separate or otherwise project free of the loop, depending upon the particular embodiment of the invention herein illustrated and described.

As heretofore mentioned, although in the illustrated embodiments of the invention a springlike wire or metal band is shown for the formation of the closed loop, it would also be possible to fabricate the holder of a rigid but resilient plastic material, such as, high density polyethylene, as would be appresented by those skilled in the art of plastic molding or extrusion.

Although the various described versions are shown as having a loop body of round or rectangular cross-section, it is contemplated that all of them can be constructed of a body material having any of a great number of cross-sectional geometries and still be within the spirit of the invention.

I claim:

1. A manual pressure operable key holder comprising:

a length of resilient spring-like material formed into a closed loop disposed in a vertical plane, said loop having terminal fingers which join and lap each other side by side in a vertical lap interface coinciding generally with the plane of the loop and with the fingers pointing in opposite directions, said lapping fingers each being formed in to corresponding sinuous like segments wherein the lap-interface of each finger is flat and non-snagging and comprises a proximal section which bulges toward the other finger, and an adjoining distal section which includes a recess, shaped to receive the bulge section of the other finger;

the internal stresses of the closed loop being such that in the absence of external pressure, the lapped fingers nest with each other and remain in snug and non-snagging contact along the entire length of the lap-interface presenting no obstruction to a key on the loop passing in either direction across the lap juncture, but whereby, with the lap juncture at the top of the loop, upon the application of squeezing pressure to opposed sides of the loop to urge the sides toward each other, said fingers un-nest from each other and the tip of each finger is moved away from the other finger by the camming action of the opposed bulges sliding against each other thereby leaving only a small area of contact between the fingers and enabling a key having the orifice near one end to be threaded onto the tip of one of the fingers and passed between said fingers and onto the loop or alternatively to enable a key already on the loop to be passed onto one of the fingers from the proximal end, thence passing between the fingers, and off the loop;

and the inherent resilience of the loop being such that upon termination of said squeezing pressure, said fingers return to their nested position.

2. The key holder of claim 1, further characterized in that the closed loop is of generally circular configuration, the lapping fingers are curved to follow such configuration and the length of each finger constitutes approximately one-fifth of the total circumference of the loop.

3. The key holder of claim 1, further characterized in that the loop is generally in the shape of the letter "D" turned on its side with the lapping fingers horizontally positioned at the top of the loop in the straight portion of the "D"; the degree of lapping of the fingers being such that they are partially lapped when the fingers are nested and fully lapped when the fingers are un-nested.

* * * * *